US008704815B2

(12) United States Patent
Li et al.

(10) Patent No.: US 8,704,815 B2
(45) Date of Patent: Apr. 22, 2014

(54) DISPLAY DEVICE CAPABLE OF SWITCHING GATE HIGH VOLTAGE

(75) Inventors: Hung-Chun Li, Taipei County (TW); Chun-Chieh Wang, Chiayi County (TW); Tung-Hsin Lan, Taipei (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 241 days.

(21) Appl. No.: 13/158,481

(22) Filed: Jun. 13, 2011

(65) Prior Publication Data

US 2012/0105411 A1 May 3, 2012

(30) Foreign Application Priority Data

Oct. 27, 2010 (TW) ..... 99136810 A

(51) Int. Cl.
*G09G 3/36* (2006.01)

(52) U.S. Cl.
USPC ..... 345/211; 345/212; 345/204

(58) Field of Classification Search
CPC ..... G09G 3/36; G09G 3/3696
USPC ..... 345/87–100, 211–213; 327/536
See application file for complete search history.

(56) References Cited

U.S. PATENT DOCUMENTS

2002/0036636 A1* 3/2002 Yanagi et al. ..... 345/211
2008/0036725 A1 2/2008 Lee et al.
2008/0054987 A1 3/2008 Choi et al.
2008/0100560 A1 5/2008 Na et al.
2008/0284497 A1* 11/2008 Kim et al. ..... 327/536
2009/0073154 A1* 3/2009 Lee et al. ..... 345/211
2010/0053054 A1* 3/2010 Jeong et al. ..... 345/92
2011/0115771 A1* 5/2011 Cheng et al. ..... 345/211
2011/0116592 A1* 5/2011 Tsai ..... 377/79
2011/0157148 A1* 6/2011 Jang et al. ..... 345/213

FOREIGN PATENT DOCUMENTS

CN 101650924 A 2/2010
CN 101707054 5/2010

OTHER PUBLICATIONS

"First Office Action of China Counterpart Application", issued on Sep. 10, 2012, p. 1-p. 7, in which the listed reference was cited.
"Office Action of Taiwan Counterpart Application", issued on Sep. 11, 2013, p. 1-p. 7, in which the listed reference was cited.

* cited by examiner

*Primary Examiner* — Srilakshmi K Kumar
*Assistant Examiner* — James Nokham
(74) *Attorney, Agent, or Firm* — Jianq Chyun IP Office

(57) ABSTRACT

A display device including a first voltage generator, a second voltage generator, a timing controller, a level shifter and a display panel is provided. The first voltage generator is configured to generate a gate high voltage. During a first period, the gate high voltage is a first voltage. After the first period, the gate high voltage is a second voltage. The first voltage is higher than the second voltage. The second voltage generator is configured to generate a gate low voltage. According to the gate high voltage and the gate low voltage, the level shifter shifts the voltage levels of the start signal, the clock signal and the inverse signal produced by the timing controller for driving a plurality of shift registers disposed on a substrate of the display panel. The shift registers is configured to output scanning signals in sequence.

12 Claims, 5 Drawing Sheets

DISPLAY DEVICE CAPABLE OF SWITCHING GATE HIGH VOLTAGE

CROSS-REFERENCE TO RELATED APPLICATION

This application claims the priority benefit of Taiwan application serial no. 99136810, filed Oct. 27, 2010. The entirety of the above-mentioned patent application is hereby incorporated by reference herein and made a part of this specification.

BACKGROUND OF THE INVENTION

1. Field of the Invention

The present invention generally relates to a display device and a driving method thereof. More particularly, the present invention relates to a display device and a driving method capability of inhibiting abnormal displaying.

2. Description of Related Art

In recent years, with the rapid development of semiconductor technology, portable electronic products and flat panel display products also become popular. In a variety of types of flat panel displays, liquid crystal display (LCD) has the advantages of low voltage operation, no radiation, light weight and compact volume, therefore it is a major product of display devices.

In order to reduce production cost of liquid crystal displays, some manufacturers have presented to produce multi-stage shift registers directly onto the glass substrate by using thin film transistors to replace conventional gate driver ICs and reduce the production cost of liquid crystal displays.

Due to influence of the process, thin film transistors manufactured by the process may have low output capacity. In this situation, if the shift registers consist of the thin film transistors having low output capacity, the signals of the shift registers cannot be shifted normally in the initial period of displaying so that the screen cannot be displayed normally. In addition, after waiting for a period of time, the output capacity of the thin film transistors can be elevated due to risen temperature, the signals of the shift registers can be shifted normally. However, the above-mentioned problem about the screen cannot be displayed normally in the initial period of displaying still exists.

SUMMARY OF THE INVENTION

The present invention is directed to a display device and driving method for inhibiting abnormal display phenomena.

The present invention provides a display device comprising a first voltage generator, a second voltage generator, a timing controller, a level shifter and a display panel. The first voltage generator is configured to generate a gate high voltage. The gate high voltage is a first voltage during a first period and the gate high voltage is a second voltage after the first period, and the first voltage is higher than the second voltage. The second voltage generator is configured to generate a gate low voltage. The timing controller generating a start signal, a clock signal and an inverse signal. The level shifter is coupled to the first voltage generator, the second voltage generator and the timing controller, and the level shifter shifts voltage levels of the start signal, the clock signal and the inverse signal according to the gate high voltage and the gate low voltage. The display panel comprises a substrate, a pixel array disposed on the substrate and a plurality of shift registers disposed on the substrate. The shift registers are coupled to the level shifter respectively, and sequentially outputs a plurality of scanning signals for driving the pixel array according to the shifted start signal, the shifted clock signal and the shifted inverse signal.

In an embodiment of the present invention, the first voltage generator comprises a first pulse width modulator, a first charge pumping circuit, a first resistance, a second resistance and an adjusting circuit. The first pulse width modulator has a first input terminal, a second input terminal and an output terminal. The first input terminal of the first pulse width modulator is coupled to a first reference voltage, and the first pulse width modulator outputs a first driving signal from the output terminal thereof according to the first reference voltage and a voltage of the second input terminal thereof. The first charge pumping circuit has an input terminal and an output terminal, and the input terminal of the first charge pumping circuit is coupled to the first pulse width modulator for receiving the first driving signal and outputting the gate high voltage from the output terminal thereof according to the first driving signal. The first resistance couples between the output terminal of the first charge pumping circuit and the second input terminal of the first pulse width modulator. The second resistance couples between the second input terminal of the first pulse width modulator and a ground voltage. The adjusting circuit is coupled to the second input terminal of the first pulse width modulator for reducing the voltage of the second input terminal of the first pulse width modulator during the first period and restoring a voltage of the second input terminal of the first pulse width modulator after the first period.

In an embodiment of the present invention, the adjusting circuit comprises a transistor, a third resistance, a fourth resistance and a first capacitor. The transistor has a first terminal, a second terminal and a control terminal, wherein the first terminal is coupled to the second input terminal of the first pulse width modulator, and the control terminal receives a second reference voltage. The third resistance couples between the second terminal of the transistor and the ground voltage. The fourth resistance couples between the control terminal of the transistor and the ground voltage, and the first capacitor is parallel coupled to the fourth resistance.

In an embodiment of the present invention, the first voltage generator further comprises a first thermistor coupling to the first resistance in parallel.

In an embodiment of the present invention, the first thermistor is a thermistor with a negative temperature coefficient.

In an embodiment of the present invention, the transistor is a PMOS transistor.

In an embodiment of the present invention, the second voltage generator comprises a second pulse width modulator, a second charge pumping circuit, a fifth resistance, a sixth resistance and a second capacitor. The second pulse width modulator has a first input terminal, a second input terminal and an output terminal, and the first input terminal of the second pulse width modulator is coupled to a third reference voltage. The second pulse width modulator outputs a second driving signal from the output terminal thereof according to the third reference voltage and a voltage of the second input terminal thereof. The fifth resistance couples between the first input terminal and the second input terminal of the second pulse width modulator. The second charge pumping circuit has an input terminal and an output terminal, and the second charge pumping circuit outputs the gate low voltage from the output terminal thereof according to a signal of the input terminal thereof. The sixth resistance couples between the second input terminal of the second pulse width modulator and the output terminal of the second charge pumping circuit.

The second capacitor couples the output terminal of the second pulse modulator and the input terminal of the second charge pumping circuit.

In an embodiment of the present invention, the second voltage generator further comprises a second thermistor coupling to the fifth resistance in parallel.

In an embodiment of the present invention, the second thermistor is a thermistor with a negative temperature coefficient.

In an embodiment of the present invention, the gate low voltage is a third voltage.

In an embodiment of the present invention, the gate low voltage is the ground voltage during the first period, and the gate low voltage is a third voltage after the first period.

In an embodiment of the present invention, the voltage difference between the first voltage and the second voltage is greater than or equal to 2 V.

In an embodiment of the present invention, the first period starts at the timing that the display device is booted up.

The present invention also provides a driving method for driving a display panel. The driving method comprises the following steps: providing a gate high voltage having a voltage level at a first voltage and a gate low voltage during a first period; providing the gate high voltage having a voltage level at a second voltage and the gate low voltage after the first period; shifting the voltage levels of a start signal, a clock signal and an inversion signal according to the gate high voltage and the gate low voltage thereof; and driving the display panel by using the shifted start signal, the shifted clock signal and the shifted inversion signal.

In an embodiment of the present invention, the voltage level of the gate low voltage is a third voltage.

In an embodiment of the present invention, the voltage level of the gate low voltage is a ground voltage during the first period, and the voltage level of the gate low voltage is a third voltage after the first period.

In an embodiment of the present invention, the value of the third voltage is inversely proportional to the value of a temperature.

In an embodiment of the present invention, the values of the first voltage and the second voltage are inversely proportional to the value of the temperature.

Based on the above mentioned, the display device and the driving method thereof of the present invention utilizes a higher gate high voltage to drive shift registers during the first period, therefore the problem that the shift registers cannot work normally due to lower output capacities of the thin film transistors can be prevented.

In order to the make the aforementioned and other objects, features and advantages of the present invention comprehensible, several embodiments accompanied with figures are described in detail below.

DESCRIPTION OF EMBODIMENTS

Figure 1:
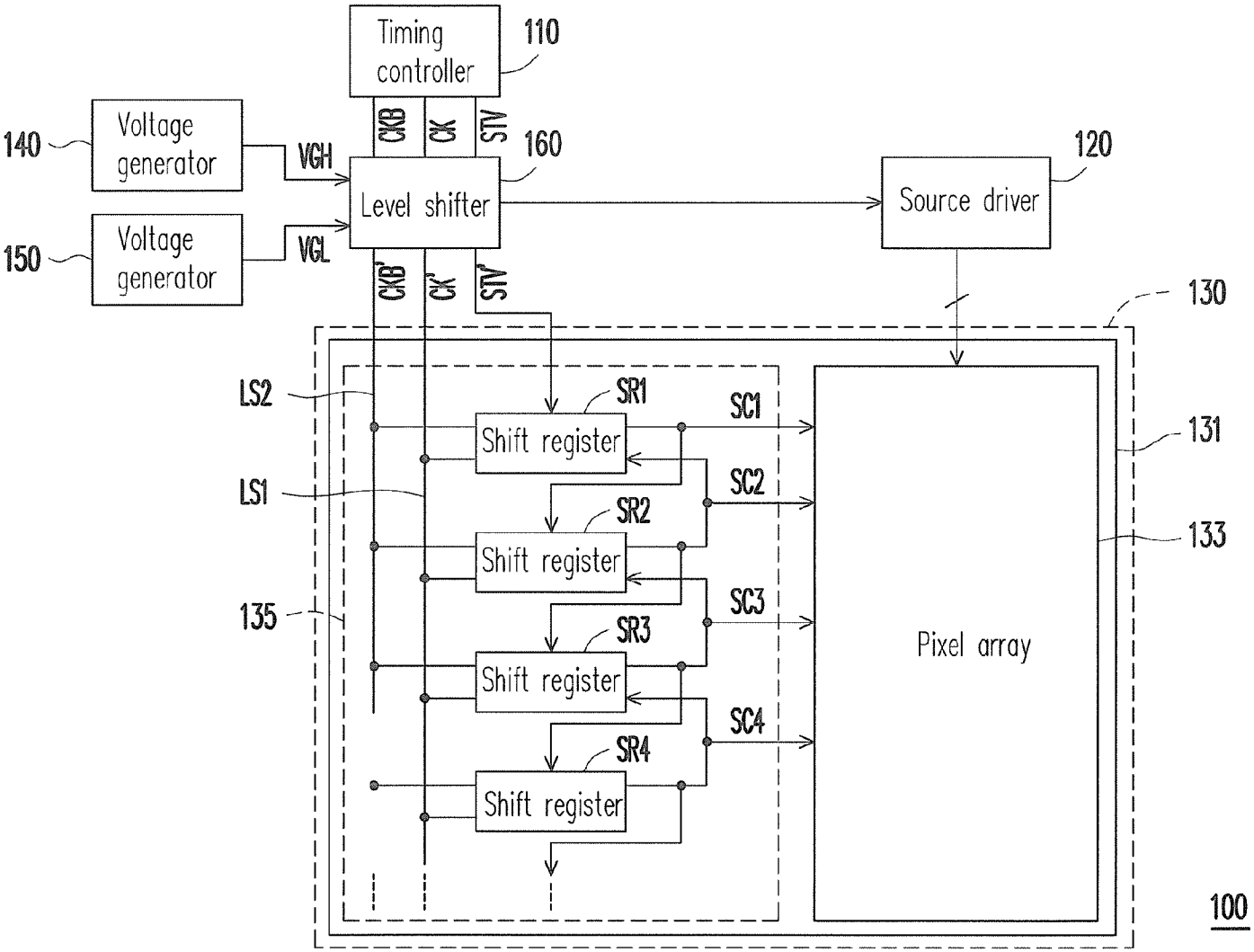
FIG. 1 is a system diagram illustrating a display device according to one embodiment of the present invention.

FIG. 1 is a system diagram illustrating a display device according to one embodiment of the present invention. Referring to FIG. 1, a display device 100 comprises a timing controller 110, a source driver 120, a display panel 130, a first voltage generator 140, a second voltage generator 150 and a level shifter 160. The display panel 130 comprises a substrate 131, a pixel array 133 and a gate driver circuit 135. In the present embodiment, the gate driver circuit 135 is disposed on the substrate 131 and located at the left side of the pixel array 133. But in other embodiments, the gate driver circuit 135 can be located at the right, top or bottom sides of the pixel array 133. Moreover, the pixel array 133 of the substrate 131 is the display area of the display panel 130, and the area where the gate driver circuit 135 is disposed on is the non-display area of the display panel 130.

The first voltage generator 140 is configured to generate a gate high voltage VGH, and the second voltage generator 150 is configured to generate a gate low voltage VGL. The timing controller 110 is configured to generate start signals STV, clock signals CK and CKB, wherein the clock signals CKB are inverse signals of the clock signals CK. The level shifter 160 is coupled to the first voltage generator 140, the second voltage generator 150 and the timing controller 110 to receive the gate high voltage VGH, the gate low voltage VGL, the start signals STV and the clock signals CK and CKB. The level shifter 160 shifts voltage levels of the start signals STV, the clock signals CK and CKB according to the gate high voltage VGH and the gate low voltage VGL, and then outputs the start signals STV', the clock signals CK' and CKB'. According to the start signals STV', the clock signals CK' and CKB", the gate driver circuit 135 outputs scanning signals SC1, SC2, SC3, SC4, etc. in sequence, in order to drive each row of pixels (not shown) in the pixel array 133. The source driver 120 is controlled by the timing controller 110 and then outputs corresponding display data to the driven pixels.

The Gate driver circuit 135 comprises shift registers SR1, SR2, SR3, SR4, etc. The shift registers SR1, SR2, SR3, SR4, etc. receives the clock signals CK' and the clock signals CKB' simultaneously, wherein the clock signals CK' are delivered to the shift registers SR1, SR2, SR3, SR4, etc. via a signal wire LS1 on the substrate 131, and the clock signals CKB' are delivered to the shift registers SR1, SR2, SR3, SR4, etc. via a signal wire LS2 on the substrate 131. Also, the signal wires LS1 and LS2 can be set in the gate driver circuit 135.

Figure 2:
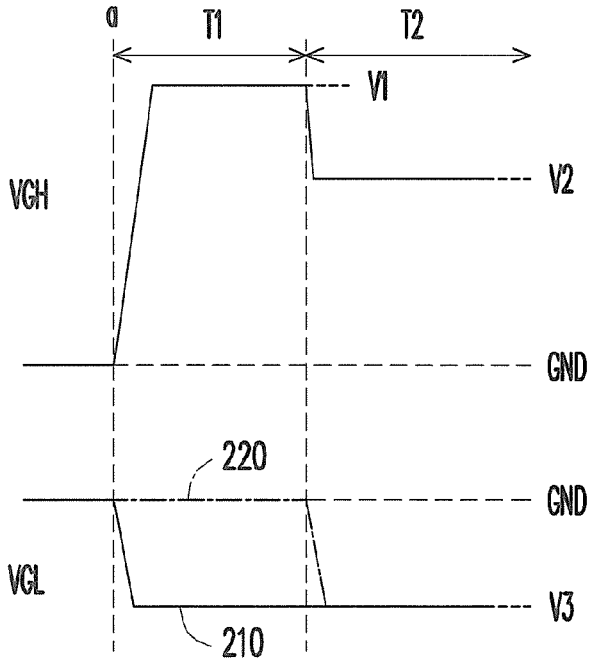
FIG. 2 is a waveform diagram illustrating the gate high voltage and the gate low voltage according to one embodiment of the present invention.

FIG. 2 is a waveform diagram illustrating the gate high voltage and the gate low voltage according to one embodiment of the present invention. Referring to FIG. 1 and FIG. 2, in the present embodiment, the starting point a of a first period T1 is the timing that the display device is booted up. During the first period T1, the gate high voltage VGH rises to a first voltage V1 from a ground voltage GND and maintains at the first voltage V1. The gate low voltage VGL may drop to a third voltage V3 (as waveform 210 has shown) from the ground voltage, or may maintain at the ground voltage (as waveform 220 has shown). After the first period T1 (as the second period T2 has shown), the gate high voltage VGH may drop to a second voltage V2 from the first voltage V1 and then maintains at the second voltage V2. The gate low voltage VGL can maintain at the third voltage V3 (as waveform 210 has shown), or it may drop to the third voltage V3 (as waveform 220 has shown) from the ground voltage.

As shown in FIG. 2, the second voltage V2 here is known as the gate high voltage VGH, i.e. a high voltage level for the start signals STV' and the clock signals CK' and CKB'. Due to influence of the process, thin film transistors in the shift registers (such as SR1~SR4) may have lower output capacities, and in the initial period (during the first period T1), the temperature of the gate driver circuit 135 is about the same to room temperature, so that the shift registers (such as SR1~SR4) cannot work normally as driven by conventional gate high voltages. Therefore, during the first period T1, in the present embodiment, the first voltage V1, higher than the second voltage V2, is served as the gate high voltage VGH. By using higher voltages, output capacities of the thin film transistors can be elevated and the rise of the temperature also can be accelerated. Therefore, the duration of abnormal displaying can be decreased, or even the display device can display normally at the booted-up, so that the layout of the shift registers (such as SR1~SR4) don't need to be altered as shown in the present embodiment.

Generally speaking, an ideal first voltage V1 may be as high as possible, and the inhibition effect for abnormal displaying will be obvious as the first voltage V1 is higher than the second voltage V2 over 2 V, but in practical application, the voltage difference between the first voltage V1 and the second voltage V2 can be designed as from 2 to 5 V, depending on what kinds of structures of thin film transistors are used. Also, after the first period T1, because the temperature of the gate driver circuit 135 has been raised and then the output capacities of the thin film transistors are elevated, the gate high voltage VGH can be lower to the second voltage V2 without influence for the image display, and accelerating the degradation of the thin film transistors and destroying the thin film transistors due to driving by high voltage for a long time can be prevented.

Referring to FIG. 1, in more details, when the shift register SR1 receives the start signal STV', the shift register SR1 will be set in a driving state. Then, the shift register SR1 will output a scanning signal SC1 according to the start signal STV', the clock signals CK' and CKB'. And the scanning signal SC1 is delivered to the shift register SR2.

When the shift register SR2 receives the scanning signal SC1, the shift register SR2 will be set in the driving state. Then, the shift register SR2 will output a scanning signal SC2 according to the scanning signal SC1, the clock signals CK' and CKB'. And, the scanning signal SC2 is delivered to the shift registers SR1 and SR3. In the meantime, when the shift register SR1 receives the scanning signal SC2, the shift register SR1 will be in a stop state to stop outputting the scanning signal SC1, for preventing from the scanning signal SC1 overlapping with the scanning signal SC2.

When the shift register SR3 receives the scanning signal SC2, the shift register SR3 will be set in the driving state. Then, the shift register SR3 will output a scanning signal SC3 according to the scanning signal SC2, the clock signals CK' and CKB'. And the scanning signal SC3 is delivered to the shift registers SR2 and SR4. In the meantime, when the shift register SR2 receives the scanning signal SC3, the shift register SR2 will be in a stop state to stop outputting the scanning signal SC2, for preventing from the scanning signal SC2 overlapping with the scanning signal SC3.

According to the aforementioned, the skilled in the art can understand how the remaining shift registers (such as SR4, etc.) operate and output corresponding scanning signals (such as SC4, etc.). By this way, the gate driver 135 will output the scanning signals SC1, SC2, SC3, etc. in sequence for driving each row of pixels (not shown) in the pixel array.

Figure 3:
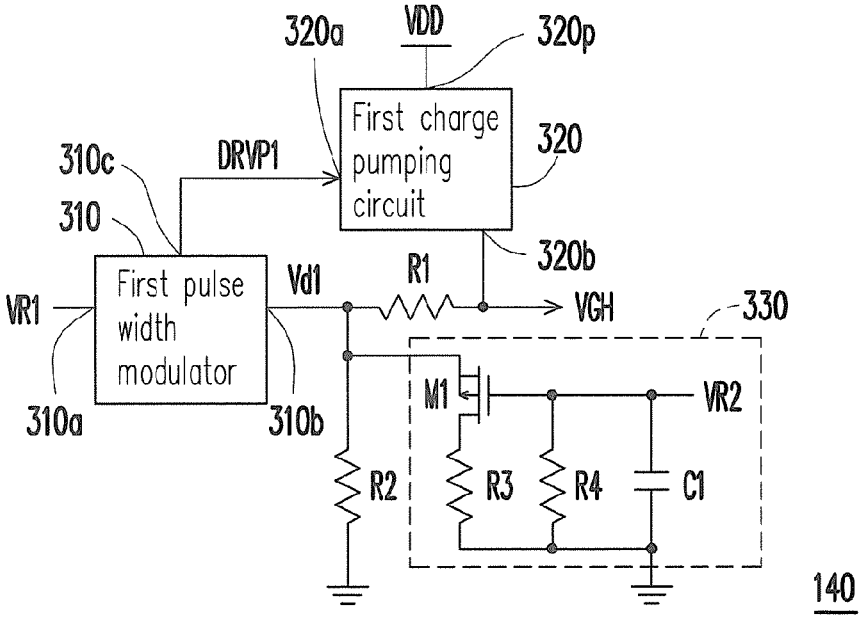
FIG. 3 is a circuit diagram illustrating the first voltage generator 140 in FIG. 1 according to one embodiment of the present invention.

FIG. 3 is a circuit diagram illustrating the first voltage generator 140 in FIG. 1 according to one embodiment of the present invention. Referring to FIG. 3, in the present embodiment, the first voltage generator 140 comprises a first pulse width modulator 310, a first charge pumping circuit 320, a first resistance R1, a second resistance R2, a third resistance R3, a fourth resistance R4, a transistor M1 and a first capacitor C1, wherein the transistor M1, for example, is a PMOS transistor. The first pulse width modulator 310 has a first input terminal 310*a*, a second input terminal 310*b* and an output terminal 310*c*, and the first input terminal 310*a* is coupled to a first reference voltage VR1. The first pulse width modulator 310 compares a voltage Vd1 in the second input terminal 310*b* with the first reference voltage VR1, and then outputs a first driving signal DRVP1 from the output terminal 310*c* based the comparison result.

The first charge pumping circuit 320 has a power terminal 320*p*, an input terminal 320*a* and an output terminal 320*b*, wherein the power terminal 320*p* is coupled to a system voltage VDD, and the input terminal 320*a* is coupled to the first pulse width modulator 310 for receiving a first driving signal DRVP1. The first charge pumping circuit 320 outputs the gate high voltage VGH at the output terminal 320*b* of the first charge pumping circuit 320 according to the first driving signal DRVP1. The first resistance R1 couples the output terminal 320*b* of the first charge pumping circuit 320 and the second input terminal 310*b* of the first pulse width modulator 310. The second resistance R2 couples the second input terminal 310*b* of the first pulse width modulator 310 and the ground voltage. Based on the above, the first resistance R1 and the second resistance R2 executes a voltage dividing to generate the voltage Vd1.

The source (i.e. the first terminal) of the transistor M1 is coupled to the second input terminal 310*b* of the first pulse width modulator 310, and the gate (i.e. the control terminal) of the transistor M1 receives the second reference voltage VR2. The third resistance R3 couples between the drain (i.e. the second terminal) of the transistor M1 and the ground voltage. The fourth resistance R4 couples between the gate of the transistor M1 and the ground voltage. The first capacitor C1 is parallel coupled to the fourth resistance R4.

According to the above-mentioned, when the display device 100 is switched on, the reference voltage VR2 will charge the capacitor C1, while the charging rate depends on the value of the resistance R4 and the value of the capacitor C1. In the meantime, the gate voltage of the transistor M1 is smaller than source voltage of the transistor M1, so that the transistor M1 is turned on. The value of the gate high voltage VGH (i.e. the first voltage V1) can be calculated by the following formula:

$$V1 = Vd1 \times \left(1 + \frac{R1}{R2 // R3}\right) \tag{1}$$

wherein R1, R2 and R3 in the formula represent the values of the resistances R1, R2 and R3 respectively. Then, when the voltage difference between the gate and the source of the transistor M1 is smaller than a threshold voltage, the transistor M1 is turned off. At this time, the value of the gate high voltage VGH (i.e. the second voltage V2) can be determined by the following formula:

$$V2 = Vd1 \times \left(1 + \frac{R1}{R2}\right) \tag{2}$$

Based to the above formulas (1) and (2), in formula (1), the resistance R2 is parallel coupled to the resistance R3, therefore the first voltage V1 is higher than the second voltage V2. The timing for the gate high voltage VGH switching from the first voltage V1 to the second voltage V2 is determined by the values of the second reference voltage VR2, the resistance R4 and the capacitor C1, i.e. the duration of the first period T1 is determined by values of the second reference voltage VR2, the resistance R4 and the capacitor C1, and the duration of the first period T1 may be set to include a frame period or multiple frame periods, adjustable for the persons skilled in the art and the present invention is not limited by the disclosure above.

Furthermore, the circuit constituted by the transistor M1, the third resistance R3, the fourth resistance R4 and the first capacitor C1 can be regarded as a adjusting circuit 330, which raises the value of the voltage Vd1 during the first period T1, so that the gate high voltage is the first voltage V1, and restores the values of the voltage Vd1 after the first period T1, so that the gate high voltage VGH is the second voltage V2.

Figure 4:
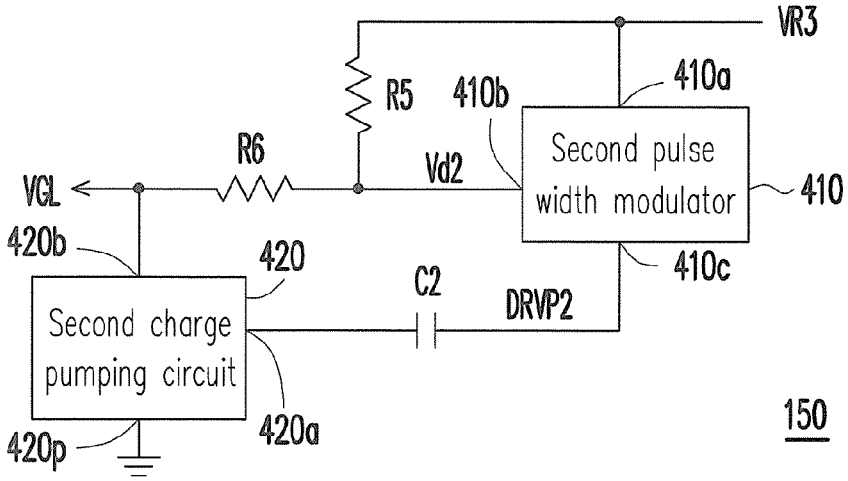
FIG. 4 is a circuit diagram illustrating the second voltage generator 150 in FIG. 1 according to one embodiment of the present invention.

FIG. 4 is a circuit diagram illustrating the second voltage generator 150 in FIG. 1 according to one embodiment of the present invention. Referring to FIG. 4, in the present embodiment, the second voltage generator 150 includes a second pulse width modulator 410, a second charge pumping circuit 420, a fifth resistance R5, a sixth resistance R6 and a second capacitor C2. The second pulse width modulator 410 has a first input terminal 410*a*, a second input terminal 410*b* and an output terminal 410*c*, wherein the first input terminal 410*a* of the second pulse width modulator 410 is coupled to a third reference voltage VR3. The second pulse width modulator 410 compares the third reference voltage VR3 with a voltage Vd2 of the second input terminal 410*b* and then outputs a second driving signal DRVP2 from the output terminal 410*c* based on the comparison result.

The fifth resistance R5 couples between the first input terminal 410*a* and second input terminal 410*b* of the second pulse width modulator 410. The second charge pumping circuit 420 has a power terminal 420*p*, an input 420*a* and an output 420*b*, wherein the power terminal 420*p* of the second charge pumping circuit 420 is coupled to a ground voltage. The second charge pumping circuit 420 outputs a gate low voltage VGL from the output terminal 420*b* based on the second driving signal DRVP2 received by the input terminal 420*a*.

The sixth resistance R6 couples between the second input terminal 410*b* of the second pulse width modulator 410 and the output terminal 420*b* of the second charge pumping circuit 420. The fifth resistance R5 and the sixth resistance R6 executes a voltage dividing to generate the voltage Vd2. The second capacitor C2 couples between the output terminal 410*c* of the second pulse width modulator 410 and the input terminal 420*a* of the second charge pumping circuit 420 for delivering the second driving signal DRVP2 to the input terminal 420*a* of the second charge pumping circuit 420.

Based on the above-mentioned, the voltage V3 of the gate low voltage VGL is determined by the following formula:

$$\begin{aligned} V3 &= [Vd2 \times (R5 + R6) - VR3 \times R6] / R5 \\ &= Vd2 + (Vd2 - VR3) \times \frac{R6}{R5} \end{aligned} \tag{3}$$

If the third reference voltage VR3 is equal to 1.25 V and the voltage Vd2 is equal to 0.25 V, formula (3) will be transformed into the following formula:

$$V3 = 0.25 - \frac{R6}{R5} \tag{4}$$

Furthermore, if the waveform 210 as shown in FIG. 2 is to be achieved, the pulse width modulator 410 should work normally at the display device 100 is booted up. In other aspect, if the waveform 220 as shown in FIG. 2 is to be achieved, the pulse width modulator 410 should work normally after the first period T1.

Figure 5:
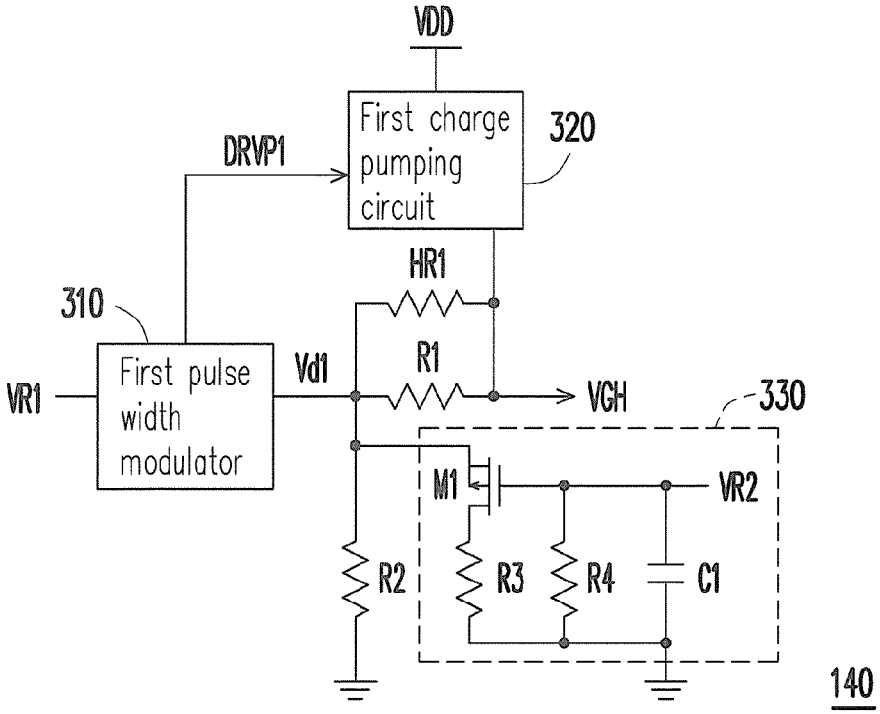
FIG. 5 is a circuit diagram illustrating the first voltage generator 140 in FIG. 1 according to another embodiment of the present invention.

FIG. 5 is a circuit diagram illustrating the first voltage generator 140 in FIG. 1 according to another embodiment of the present invention. Referring to FIG. 3 and FIG. 5, in the present embodiment, the first voltage generator 140 further includes a first thermistor HR1 coupling to the first resistance R1 in parallel, wherein the first thermistor HR1, for example, is a thermistor with a negative temperature coefficient, i.e. the lower temperature is, the larger the resistance value is, and the higher temperature is, the smaller the resistance value is. After incorporating the first thermistor HR1, formula (1) and (2) will be transformed into formula (5) and (6) as follows:

$$V1 = Vd1 \times \left(1 + \frac{R1 \,//\, HR1}{R2 \,//\, R3}\right) \tag{5}$$

$$V2 = Vd1 \times \left(1 + \frac{R1 \,//\, HR1}{R2}\right) \tag{6}$$

According to formula (5) and (6), when the temperature is higher, the first voltage V1 and the second voltage V2 will be lower, and when the temperature is lower, the first voltage V1 and the second voltage V2 will be higher. This will inhibit exceedingly high output capacities of the thin film transistors in response to the condition that the thin film transistors have higher output capacities as the temperature is higher. Also, in response to the condition that the thin film transistors have lower output capacities as the temperature is lower, the output capacities of the thin film transistors can be elevated by using higher gate high voltage VGH for preventing from the abnormal displaying as the shift register cannot work normally.

In addition, besides parallel coupled to the first resistance R1, the first thermistor resistance HR1 can also be coupled to the second resistance R2 in series, by the way, the first voltage V1 and the second voltage V2 can be adjusted according to temperature changes. Furthermore, if the first thermistor HR1 is a thermistor with a positive temperature coefficient i.e. the higher temperature is, the larger the resistance value is, and the lower temperature is, the smaller the resistance value is, the first thermistor HR1 may be coupled to the first resistance R1 in series or parallel coupled to the second resistance R2. However, other coupling types of the first thermistor HR1 are not limited by the descriptions above, the person who has common knowledge in this technical field can alter the layout based on the present embodiment, even multiple thermistors can be applied for achieving the object in adjust the first voltage V1 and the second voltage V2 based on temperature changes.

Figure 6:
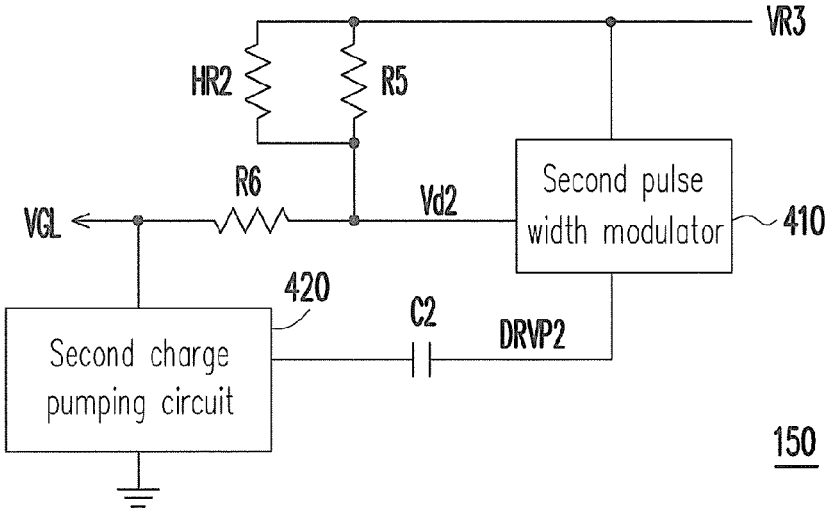
FIG. 6 is a circuit diagram illustrating the second voltage generator 150 in FIG. 1 according to another embodiment of the present invention.

FIG. 6 is a circuit diagram illustrating the second voltage generator 150 in FIG. 1 according to another embodiment of the present invention. Referring to FIG. 4 and FIG. 6, in the present embodiment, the second voltage generator 150 further includes a second thermistor HR2 parallel coupled to a fifth resistance R5, wherein the second thermistor HR2 is assumed that a thermistor with a negative temperature coefficient. After incorporating the second thermistor HR2, formula (4) will be transformed into the following formula:

$$V3 = 0.25 - \frac{R6}{R5 // HR2} \tag{7}$$

According to formula (7), when the temperature is higher, the third voltage V3 is smaller, and when the temperature is lower, the third voltage V3 is higher. In response to the condition that the thin film transistors have lower output capacities due to higher temperature, a much-lower gate low voltage VGL can be used to suppress the increasing leakage currents of the thin film transistors resulting from temperature rising.

In addition, besides parallel coupled to the fifth resistance R5, the second thermistor resistance HR2 can also be coupled to the sixth resistance R6 in series, by the way, the third voltage V3 can be adjusted according to temperature changes. Furthermore, if the second thermistor HR2 is assumed that a thermistor with a positive temperature coefficient, the second thermistor HR2 may be coupled to the fifth resistance R5 in series or parallel coupled to the sixth resistance R6. However, other coupling types of the second thermistor HR2 are not limited by the descriptions above, the person who has common knowledge in this technical field can alter the layout based on the present embodiment, even multiple thermistors can be applied for achieving the object in adjust the third voltage V3 based on temperature changes.

Figure 7:
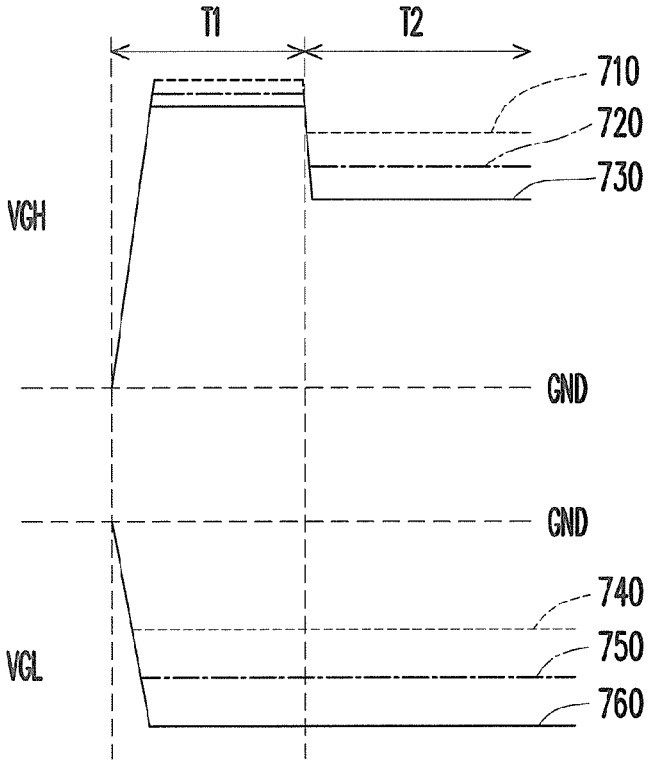
FIG. 7 is waveform diagram illustrating the gate high voltage and the gate low voltage according to another embodiment of the present invention.

FIG. 7 is waveform diagram illustrating the gate high voltage and the gate low voltage according to another embodiment of the present invention. Referring to FIG. 5 to FIG. 7, in this embodiment, by incorporating the first thermistor HR1 and the second thermistor HR2 respectively into the first voltage generator 140 and the second voltage generator 150, the gate high voltage VGH and the gate low voltage VGL can be adjusted according to temperature changes. As shown in FIG. 7, waveforms 710, 720 and 730 are voltage waveforms of the gate high voltage VGH corresponding to different temperatures respectively, and are arranged in an order from low to high according to the corresponding temperatures. Waveforms 740, 750 and 760 are voltage waveforms of the gate low voltage VGL corresponding to different temperatures respectively, and are arranged in an order from low to high according to the corresponding temperatures.

Figure 8:
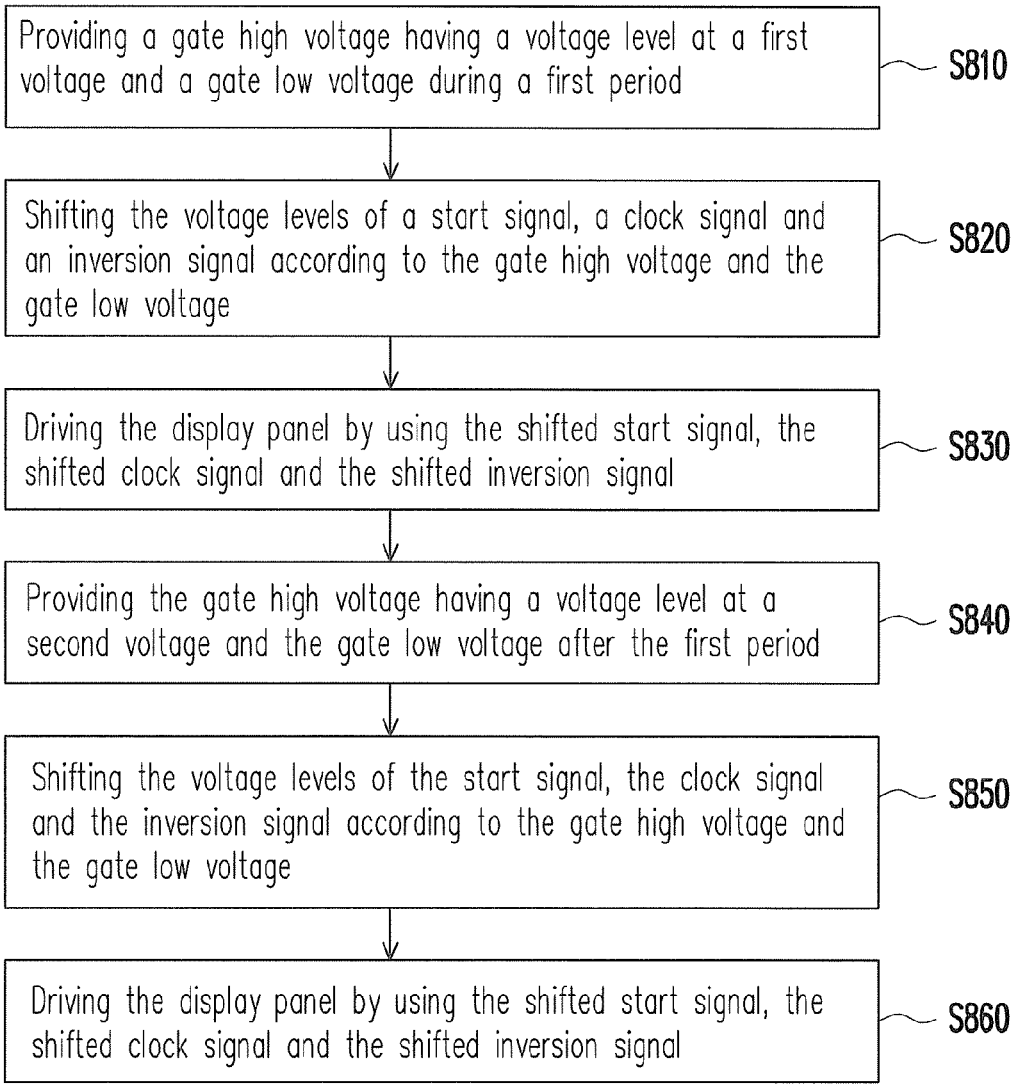
FIG. 8 is a flowchart illustrating the driving method of a display panel according to one embodiment of the present invention.

According to the above, a driving method applied in the display panel 130 can be concluded. FIG. 8 is a flowchart illustrating the driving method of a display panel according to one embodiment of the present invention. Referring to FIG. 8, during a first period, a gate high voltage having a voltage level at a first voltage and a gate low voltage are provided (step S810). Then, the voltage levels of a start signal, a clock signal and an inversion signal are shifted according to the gate high voltage and the gate low voltage (step S820). The display panel 130 is driven by using the shifted start signal, the shifted clock signal and the shifted inversion signal (step S830). The gate high voltage having a voltage level at a second voltage and the gate low voltage after the first period are provided (step S840). Thereafter, the voltage levels of the start signal, the clock signal and the inversion signal are shifted according to the gate high voltage and the gate low voltage similarly (step S850). Furthermore, the display panel is driven by using the shifted start signal, the shifted clock signal and the shifted inversion signal (step S860). Details of the above steps can refer to the descriptions of the operation for the above-mentioned display device 100, and they are not repeated here.

In summary, the display device and the driving method thereof in the embodiments of the present invention utilizes a higher gate high voltage to drive shift registers during the first period, therefore the problem that the shift registers cannot work normally due to lower output capacities of the thin film transistors can be prevented. Moreover, by incorporating a thermistor into the first voltage generator and the second voltage generator respectively, the gate high voltages and the gate low voltages can be adjusted according to the inverse proportions of the temperatures. Therefore, the problems that exceedingly high output capacities and leakage currents of the thin film transistors resulting from extremely high temperatures, and other problems that the shift registers cannot work normally due to extremely low temperature both can be prevented.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A display device, comprising:

a first voltage generator, configured to generate a gate high voltage, wherein the gate high voltage is a first voltage during a first period and the gate high voltage is a second voltage after the first period, and the first voltage is higher than the second voltage;

a second voltage generator, configured to generate a gate low voltage;

a timing controller, generating a start signal, a clock signal and an inverse signal;

a level shifter, coupled to the first voltage generator, the second voltage generator and the timing controller, the level shifter shifting voltage levels of the start signal, the clock signal and the inverse signal according to the gate high voltage and the gate low voltage; and a display panel, comprising:

a substrate;

a pixel array, disposed on the substrate; and a plurality of shift registers disposed on the substrate, and the shift registers coupled to the level shifter respectively, the shift registers sequentially outputting a plurality of scanning signals for driving the pixel array according to the shifted start signal, the shifted clock signal and the shifted inverse signal, wherein the first voltage generator comprises:

a first pulse width modulator, having a first input terminal, a second input terminal and an output terminal, the first input terminal of the first pulse width modulator coupled to a first reference voltage, the first pulse width modulator outputting a first driving signal from the output terminal thereof according to the first reference voltage and a voltage of the second input terminal thereof;

a first charge pumping circuit, having an input terminal and an output terminal, the input terminal of the first charge pumping circuit coupled to the first pulse width modulator for receiving the first driving signal and outputting the gate high voltage from the output terminal thereof according to the first driving signal;

a first resistance, coupled between the output terminal of the first charge pumping circuit and the second input terminal of the first pulse width modulator;

a second resistance, coupled between the second input terminal of the first pulse width modulator and a ground voltage; and an adjusting circuit, coupled to the second input terminal of the first pulse width modulator for reducing the voltage of the second input terminal of the first pulse width modulator during the first period and restoring the voltage of the second input terminal of the first pulse width modulator after the first period.

2. The display device of claim 1, wherein the adjusting circuit comprises:

a transistor, having a first terminal, a second terminal and a control terminal, the first terminal coupled to the second input terminal of the first pulse width modulator, and the control terminal receiving a second reference voltage;

a third resistance, coupled between the second terminal of the transistor and the ground voltage;

a fourth resistance, coupled between the control terminal of the transistor further and the ground voltage; and a first capacitor, parallel coupled to the fourth resistance.

3. The display device of claim 1, wherein the first voltage generator further comprises a first thermistor coupled to the first resistance in parallel.

4. The display device of claim 1, wherein the transistor is a PMOS transistor.

5. The display device of claim 3, wherein the first thermistor is a thermistor with a negative temperature coefficient.

6. The display device of claim 1, wherein the second voltage generator comprises:

a second pulse width modulator, having a first input terminal, a second input terminal and an output terminal, the first input terminal of the second pulse width modulator coupled to a third reference voltage, the second pulse width modulator outputting a second driving signal from the output terminal thereof according to the third reference voltage and a voltage of the second input terminal thereof;

a fifth resistance, coupled between the first input terminal and the second input terminal of the second pulse width modulator;

a second charge pumping circuit, having an input terminal and an output terminal, the second charge pumping circuit outputting the gate low voltage from the output terminal thereof according to a signal of the input terminal thereof;

a sixth resistance, coupled between the second input terminal of the second pulse width modulator and the output terminal of the second charge pumping circuit; and a second capacitor, coupled between the output terminal of the second pulse modulator and the input terminal of the second charge pumping circuit.

7. The display device of claim 6, wherein the second voltage generator further comprises a second thermistor coupled to the fifth resistance in parallel.

8. The display device of claim 7, wherein the second thermistor is a thermistor with a negative temperature coefficient.

9. The display device of claim 1, wherein the gate low voltage is a third voltage.

10. The display device of claim 1, wherein the gate low voltage is a ground voltage during the first period, and the gate low voltage is a third voltage after the first period.

11. The display device of claim 1, wherein the voltage difference between the first voltage and the second voltage is greater than or equal to 2 V.

12. The display device of claim 1, wherein the first period starts at the timing of the display device is booted up.

* * * * *